United States Patent [19]

Schultz

[11] Patent Number: 4,518,314

[45] Date of Patent: May 21, 1985

[54] DECORATIVE FAN MOTOR COVER AND MOUNTING STRUCTURE THEREFOR

[76] Inventor: Charles R. Schultz, 6616 Central Ave. SE., Albuquerque, N. Mex. 87108

[21] Appl. No.: 556,592

[22] Filed: Nov. 30, 1983

[51] Int. Cl.[3] ..... F04D 29/32; F04D 29/64

[52] U.S. Cl. ..... 416/93 R; 416/5

[58] Field of Search ..... 416/93 R, 5, 170 C

[56] References Cited

U.S. PATENT DOCUMENTS

| | | | |
|---|---|---|---|
| 585,250 | 6/1897 | Bennett | 416/5 |
| 1,752,778 | 4/1930 | Brown et al. | 416/5 |
| 1,856,017 | 4/1932 | Baker | 416/147 |
| 2,726,034 | 12/1955 | Lorenzo | 416/5 |
| 3,033,049 | 5/1962 | Morrow | 416/170 C X |
| 4,073,598 | 2/1978 | Mizutani et al. | 416/93 R X |

*Primary Examiner*—Everette A. Powell, Jr.
*Attorney, Agent, or Firm*—Harvey B. Jacobson

[57] ABSTRACT

An upwardly opening generally cylindrical decorative cover including a bottom wall having a central opening formed therein is provided and the cover is upwardly displaceable over the lower portion of a dependingly supported ceiling fan motor controlling switch housing with the central opening in the bottom wall of the cover snugly receive all but the upper portion of the switch housing therethrough and the inner periphery of the bottom wall disposed about the central opening abutted against a mounting flange structure carried by an upper portion of the switch housing and removably anchored thereagainst. The upper open portion of the cover is loosely telescoped upwardly over those portions of the ceiling fan motor projecting below the blades of the ceiling fan and disposed between the blades and the dependingly supported switch housing. The bottom wall of the cover may include openings therethrough for the passage of motor cooling air therethrough.

5 Claims, 5 Drawing Figures

DECORATIVE FAN MOTOR COVER AND MOUNTING STRUCTURE THEREFOR

BACKGROUND OF THE INVENTION

Some forms of ceiling fans include suspended motor housings from whose upper portions a bladed rotor assembly is journalled and with a fan motor controlling switch housing dependingly supported below the motor housing. Although ceiling fans of this type usually are equipped with decorative motor housings, such housing usually are either painted a decorative white or are brass or otherwise plated and these types of finishes do not always blend with or otherwise complement the decor of the associated room. The invention makes possible the easy addition of many decorative, fan housings of delicate construction, such as, wood, ceramic or glass. All the decorative housings are interchangeable, and designed to attach easily after the ceiling fan is on the ceiling. Because of this design, the decorative fan housings can be shipped separate of the heavy motors, thus eliminating breakage problems found by other fan maufacturers. Accordingly, a need exists for structure by which relatively inexpensive decorative covers may be applied over the fan motor housings in question.

BRIEF DESCRIPTION OF THE INVENTION

The decorative fan motor housing cover of the instant invention comprises an upwardly opening cylindrical shell including a bottom wall having a central opening formed therein. The shell is upwardly displaceable relative to, abuttable against and releasably mountable from flange structure provided on an upper portion of a fan motor controlling switch housing dependingly supported from the motor housing to be decoratively covered and the decorative shell is of sufficient height, when mounted from the fan motor controlling switch housing flange structure, to extend upwardly over those portions of the associated fan motor housing disposed below the upper bladed rotor of the associated ceiling fan.

The main object of this invention is to provide a decorative cover for the motor housing of a dependingly supported ceiling fan.

Another object of this invention is to provide a decorative cover which may be readily mounted in operative association with an existing ceiling fan as well as incorporated into the manufacture of new ceiling fans.

Still another object of this invention is to provide a decorative cover which may be constructed in many different shapes and sizes and be externally finished in an infinite number of ways, and be easily attachable or changeable, by the consumer, without taking off the blades, or taking the fan down.

A final object of this invention to be specifically enumerated herein is to provide a ceiling fan motor decorative cover in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
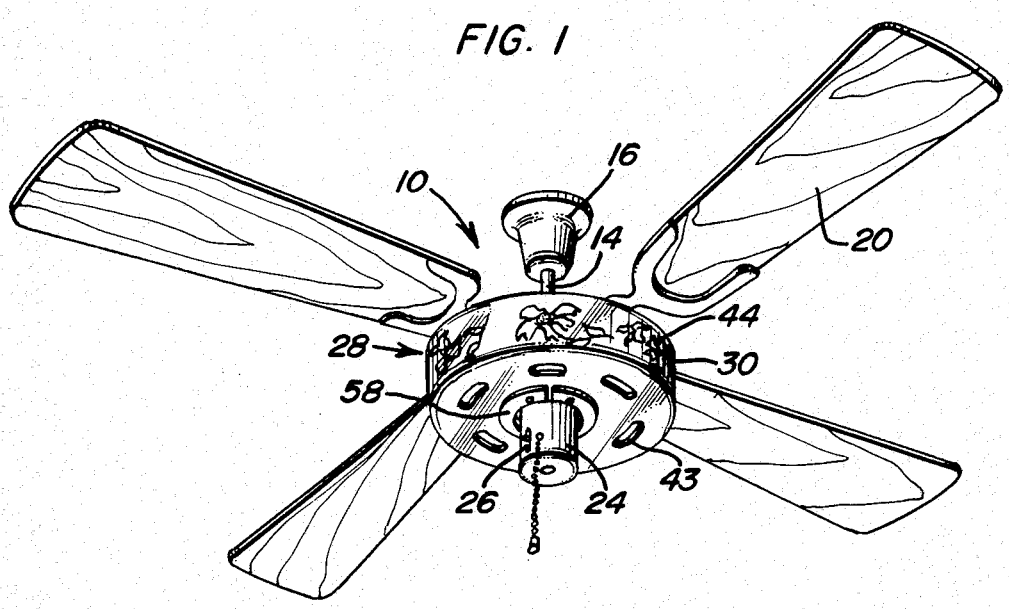
FIG. 1 is a perspective view of a ceiling fan equipped with the decorative motor housing cover of the instant invention.

Referring now more specifically to the drawings, the numeral 10 generally designates a conventional form of ceiling fan dependingly supported from an overhead ceiling 12. The fan 10 includes support structure in the form of depending elongated tubular structural member 14 anchored relative to the ceiling 12 in any convenient manner and including a decorative upwardly opening ceiling abutting housing 16 on its upper end. The lower end portion of the structural member 14 supports a motor housing 18 therefrom and the motor housing encloses an electric motor having a rotatable field upon which a bladed rotor 20 is mounted, the bladed rotor 20 being disposed above the motor housing 18.

A downward extension of the structural member 14 or a separate tubular structural member 22 depends downwardly from the lower end of the motor housing 18 and supports a motor controlling switch housing 24 from its lower end. The structural members 14 and 22 contain electrical wiring (not shown) for the motor within the housing 18 and the switch housing 24 supports a switch 26 for controlling operation of the motor within the housing 18. The foregoing may be considered as conventional ceiling fan structure.

The decorative cover assembly of the instant invention is referred to in general by the reference numeral 28 and includes a decorative cover or housing 30, a mounting flange assembly referred to in general by the reference numeral 32, a mounting gasket 34 and a retaining flange assembly referred to in general by the reference numeral 36. The cover or housing 30 comprises an upwardly opening cylindrical body 38 including a bottom wall 40 having a central opening 42 formed therein as well as peripherally spaced air inlet slots 43 spaced centrally intermediate the inner and outer peripheral portions of the bottom wall 40. The body 38 includes a decorative outer finish 44.

The mounting flange assembly 32 comprises an inverted cup-shaped body 46 including a lower end radially outwardly projecting peripheral flange 48 and the body 46 further includes an upper end wall 50 having a central opening 52 formed therein. Further, the body 46, including the flange 48 and the upper end wall 50, is radially slotted as at 54. The width of the slot 54 is substantially the same as the diameter of the tubular support member 22. Accordingly, the mounting flange assembly 32 may be radially engaged with the support member 22 intermediate the motor and switch housings 18 and 24 and then lowered into position with the upper end wall 50 of the mounting flange assembly 32 abutted against and supported from the upper end of the switch housing 24. The outer periphery of the underside of the flange 48 is relieved as at 55 and receives the annular mounting gasket 34 and the cover or housing 30 is upwardly displaced over the lower portion of the switch housing 24 to a position with the inner periphery of the bottom wall 40 abutted against the gasket 56. Then, the half annular plates 58 of the retaining flange assembly 36 are secured in place beneath the inner periphery of the bottom wall 40 by fasteners 60 passed upwardly through apertures 62 formed in the plates 58 and threaded in threaded bores 64 formed in the flange 48 inwardly of the relieved area 54. In this manner, the housing 30 may substantially fully enclose the motor housing 18.

Figure 4:
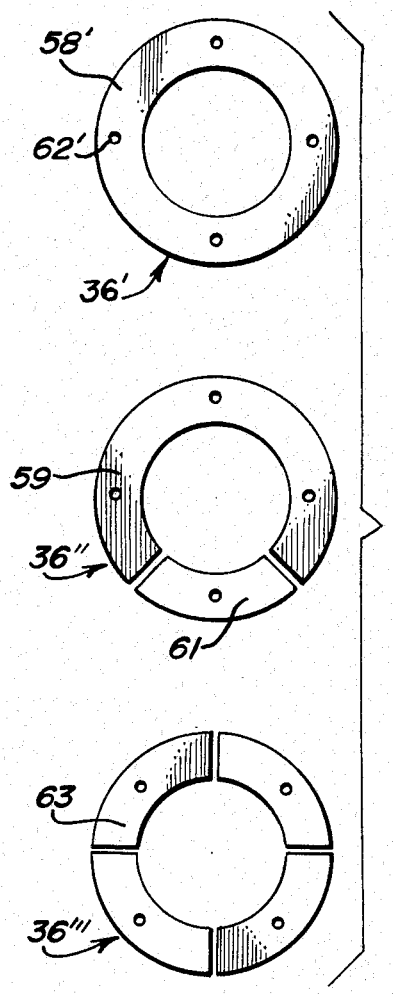
FIG. 4 is a plan view illustrating three modified forms of retaining flanges for the cover.

FIG. 4 illustrates three modified forms of retaining flange assemblies referred to in general by the reference numerals 36', 36'' and 36'''. The assembly 36' is similar to the assembly 36, except that the assembly 36' includes a peripherally continuous annular plate 58' provided with apertures 62' corresponding to the apertures 62. The assembly 36'' includes a first plate 59 of approximately 270° in annular extent and a second plate 61 which is approximately 90° in annular extent. The plates 59 and 61 together form the assembly 36''.

The assembly 36''' serves the same function as the assembly 36, except that the assembly 36''' includes four aperture plates 63 which are each approcimately 90° in angular extent.

Figure 2:
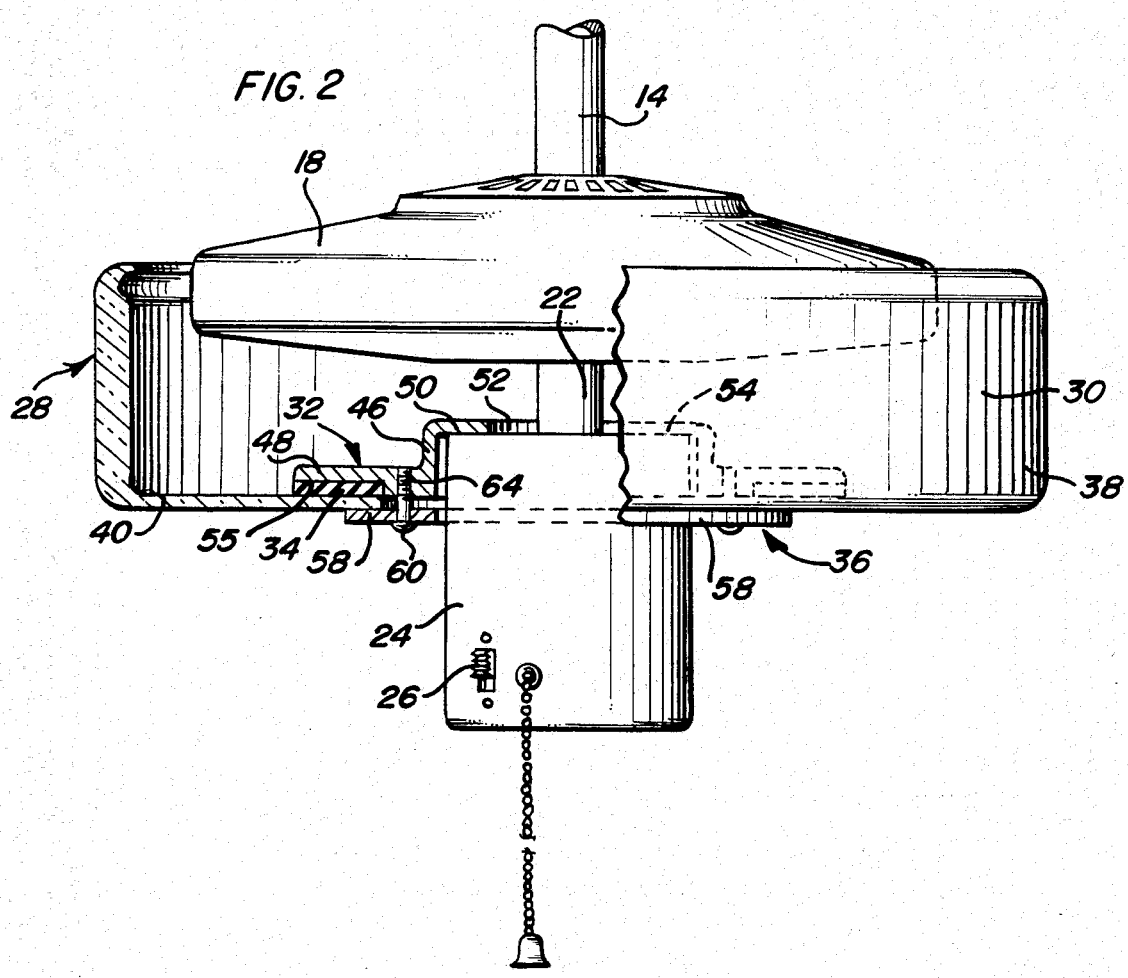
FIG. 2 is a fragmentary enlarged side elevational view of the assemblage illustrated in FIG. 1 with the bladed rotor of the fan removed and the portions of the motor housing cover and motor housing cover mounting structure broken away and illustrated in vertical sections.
Figure 3:
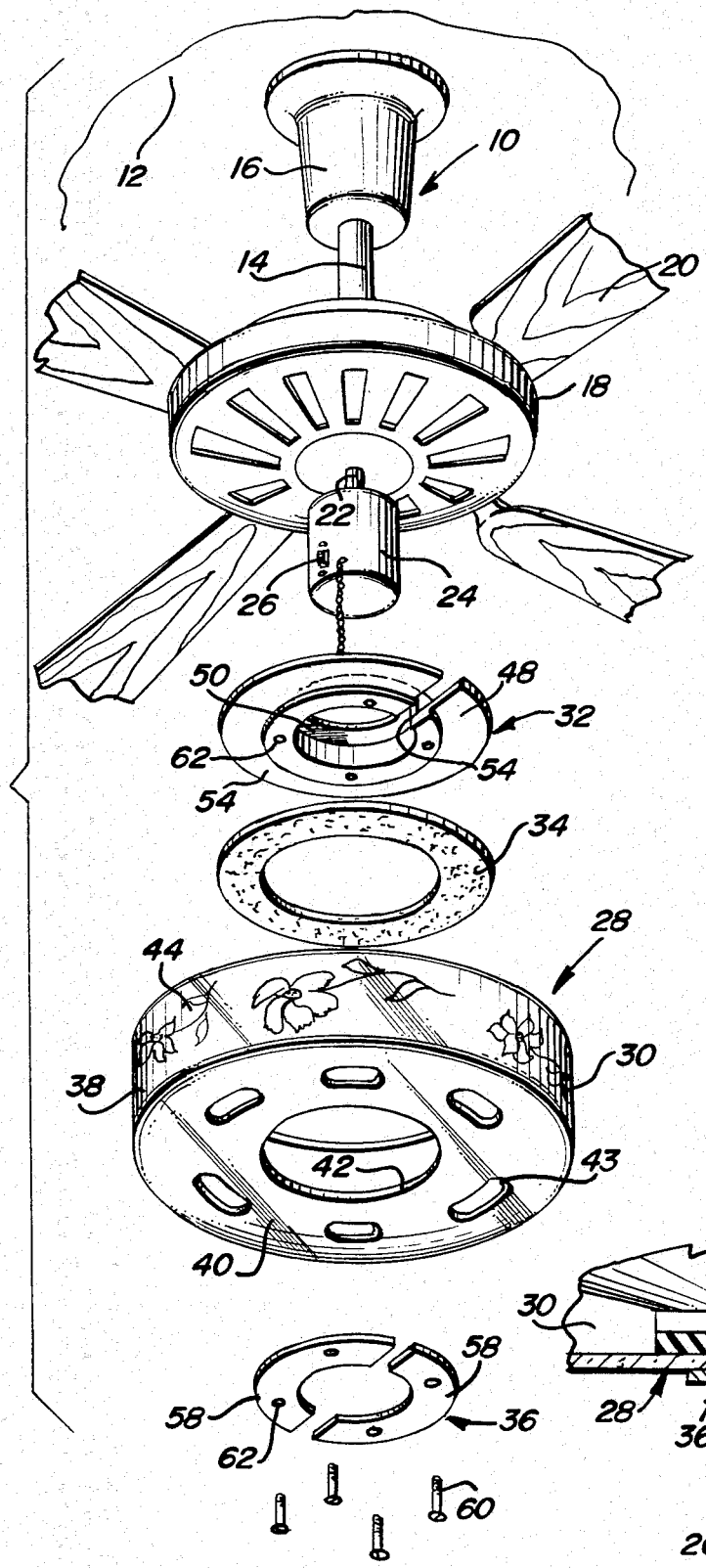
FIG. 3 is a fragmentary perspective view of the ceiling fan illustrating the cover and mounting components therefor in exploded position relative thereto.

After the cover or housing 30 has been mounted in the manner illustrated in FIG. 2, cooling air for the motor housing may enter the cover or housing 30 through the slots 43.

Figure 5:
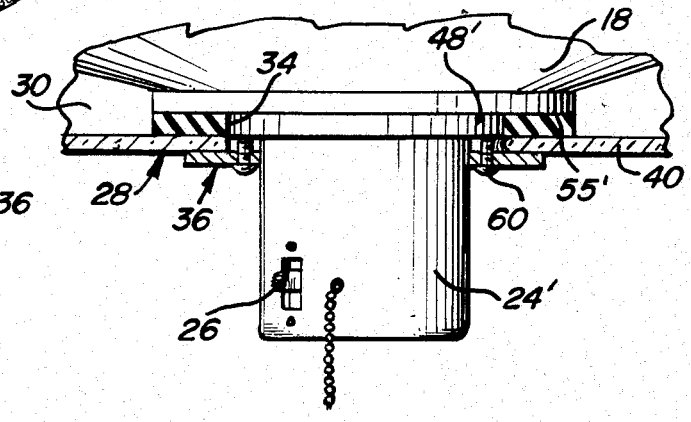
FIG. 5 is a fragmentary enlarged vertical sectional view illustrating the manner in which a fan motor controlling switch housing may be modified to provide a mounting flange for the cover of the instant invention.

With attention now invited more specifically to FIG. 5 of the drawings, there may be seen a modified form of switch housing 24' which includes an integral flange 48' corresponding to the flange 48. When the switch housing is provided with an integral flange such as the flange 48', the cover assembly 28 does not include the equivalent of the mounting flange assembly 32. Rather, the gasket 34 is seated in the relieved areas 55' of the flange 48' and the retaining flange assembly 36 is used to anchor the bottom wall 40 of the cover or housing 30 to the integral flange 48'.

It is, of course, to be noted that the decorative outer finish 44 of the housing 30 may include any suitable design and simulate any type of material. Further, if it is desired to change the decorative appearance of the housing 30, it is merely necessary to remove the four fasteners 60 and exchange a new housing 30 for the old housing removed and to then secure the new housing in position by utilizing the fasteners 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination win an existing ceiling fan including a ceiling mounted depending first support portion, a fan motor housing mounted from said first support portion, a blade equipped motor rotor journalled from an upper portion of said motor housing, a second slender support portion depending below said motor housing and supporting a horizontally enlarged motor controlling switch housing therefrom, a decorative housing assembly for said motor housing, said decorative housing assembly including, outwardly projecting mounting flange means supported from an upper portion of said switch housing, said mounting flange means including a downwardly opening inverted cup-shaped housing body including a centrally apertured upper end wall and a lower end radially outwardly projecting flange, said body, including said upper end wall and mounting flange, having a radial slot formed therein of a width at least equal to the transverse dimension of said second support portion whereby the latter may be received through said slot, said body being removably laterally engaged with said second support portion and downwardly telescoped over the upper portion of said switch housing with upper end of said switch housing abutting the underside of said upper wall, a decorative cover including a bottom wall and upstanding periphal wall means projecting upwardly from and extending about the periphery of said bottom wall, said decorative cover being open at its top and said bottom wall including a central opening formed therethrough of a size to snugly receive said switch housing therethrough, said cover being upwardly displaced over the lower portion of said switch housing to a position with the open top of said cover at least partially upwardly telescoped over said fan motor housing from therebelow and with the inner periphery of said bottom wall at least closely opposing said mounting flange means, and retaining means releasably anchoring said bottom wall relative to said mounting flange means, said retaining means comprising a generally annular retaining flange assembly underlying the inner periphery of said bottom wall, and elongated shank-type fastener means peripherally spaced about and secured upwardly through said annular retaining flange assembly, passing upwardly through said central opening inwardly of the periphery thereof and anchored relative to said mounting flange means.

2. The assembly of claim 1 wherein said annular retaining flange assembly comprises a peripherally continuous annular retaining flange.

3. The assembly of claim 1 wherein said annular retaining flange assembly comprises a plurality of arcuate retaining flanges of substantially equal angular extent.

4. The assembly of claim 1 wherein said retaining flange assembly includes first and second arcuate retaining flanges, one of said retaining flanges being appreciably greater in angular extent than the other retaining flange.

5. The assembly of claim 1 wherein said bottom wall includes air passage openings formed therethrough and spaced circumferentially about said bottom wall outwardly of said central opening.

* * * * *